United States Patent [19]

Dion

[11] Patent Number: 4,473,182

[45] Date of Patent: Sep. 25, 1984

[54] SIGNAL INDICATOR FOR MAILBOXES AND THE LIKE

[76] Inventor: Exsior Dion, 547 River Rd., Lincoln, R.I. 02865

[21] Appl. No.: 464,158

[22] Filed: Feb. 7, 1983

[51] Int. Cl.[3] ..... G08B 5/00; B65D 91/00

[52] U.S. Cl. ..... 232/35

[58] Field of Search ..... 232/34, 35, 37

[56] References Cited

U.S. PATENT DOCUMENTS

| | | | |
|---|---|---|---|
| 2,730,298 | 1/1956 | Haserodt | 232/35 |
| 3,343,784 | 9/1967 | Waldhaus et al. | 232/35 |
| 4,000,847 | 1/1977 | Duis | 232/35 |
| 4,138,056 | 2/1979 | Sherrill | 232/35 |
| 4,171,086 | 10/1979 | Hudson | 232/35 |
| 4,390,122 | 6/1983 | Savko | 232/35 |

*Primary Examiner*—Robert P. Swiatek

*Attorney, Agent, or Firm*—Robert J. Doherty

[57] ABSTRACT

A device for signaling the presence or absence of mail in mailboxes and the like. The device may be either furnished as a kit for retrofit of present mailboxes or in combination with a new mailbox. A signal member generally comprising a plate having reflector buttons mounted on opposite sides thereof is pivotally supported from a bracket in turn adapted for mounting upon the upper surface of the mailbox. The upper portion of the plate includes a forwardly downwardly extending arm terminating in a finger adapted for frictional engagement with a finger which forms the terminal portion of an arm rearwardly extending from the front door of the mailbox. When the fingers are in frictional engagement with each other, the plate is maintained in a generally horizontal attitude parallel to the top of the mailbox such that the reflectors are not generally visible. When the mailbox is opened as by the mailman to place mail therein, the signal member is urged to its upright position so as to be clearly visable to the homeowner or other receptor of mail so as to indicate the presence of mail in the mailbox.

3 Claims, 8 Drawing Figures

SIGNAL INDICATOR FOR MAILBOXES AND THE LIKE

BACKGROUND AND OBJECTS OF THE INVENTION

This invention deals with a signal device which has particular utility to indicate the presence of mail in mailboxes such as those generally found in rural free delivery zones, that is, the familiar mailbox comprising an elongated body of somewhat domed cross-sectional configuration and having a front door which is pivotally attached to the box and which opens with a forwardly downwardly directed motion. Although the present invention is particularly adapted for use with a mailbox of such specific construction, the invention has general utility as a signal means for use in conjunction with other appropriately shaped mailboxes as well as other receptacles where it is in the interest of the receiver to be able to readily observe whether or not ojbects, mail, messages, and the like have been placed into a box or other receiving structure which is positioned at a location somewhat remote from the receiver.

A recurrent problem associated with use of RFD type mailboxes or other mailboxes which may be located at a point somewhat remote from the homeowner or other mail receptor is that it is difficult to know whether mail has been placed therein and, accordingly, whether it is worthwhile to walk out to the mailbox to remove the content therefrom. This is also due at least in part by the irregular hours kept by mail delivery personnel in turn due to factors including weather, mail volume, and the like such that delivery personnel do not always deliver the mail at the same time each day. This involves keeping a watch for the mailman which occupies time that could otherwise be more usefully dealt with and even when the mailman has been observed to come to the mailbox it is not always clear whether he has left mail at your particular box or not especially when such boxes are lined in side to side groups thereof. This can decidedly be a chore for some elderly persons particularly in bad weather and for those having handicaps. Accordingly, it would be useful to include a signal device on presently in place mailbox structures or those which are hereinafter put in use such that upon the opening of the door to place mail therein, the signal is activated. Accordingly, even when mailboxes are placed in series, the receptor could from the distance clearly see the signal that mail had been placed in his or her box or at least to the extent of knowing that the access door thereto had been opened.

A further object of the present invention is the provision of a signal device of the aforementioned type which will function in such a manner so as not to interfere with the function or positioning of the red flag "mail for pickup" indicator normally found of the side of such RFD mailboxes.

These and other objects of the invention are accomplished by the provision of a signal device for use in conjunction with mailboxes and the like of the type having a generally elongated body with a downwardly pivotable door mounted at a forwardly directed access opening thereto, said device comprising a signal member which readily is visually observable in a generally upright attitude, means for pivotally mounting said signal member above said body such that it is pivotal from a first and non-signal position wherein said member is disposed in a generally horizontal attitude to a second and signal position wherein said member is in said readily visible general upright attitude, first positioning means associated with said mailbox door for positioning said signal member in said first position when said door is closed, and second positioning means for automatically moving said signal member to said second position when said door is opened.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
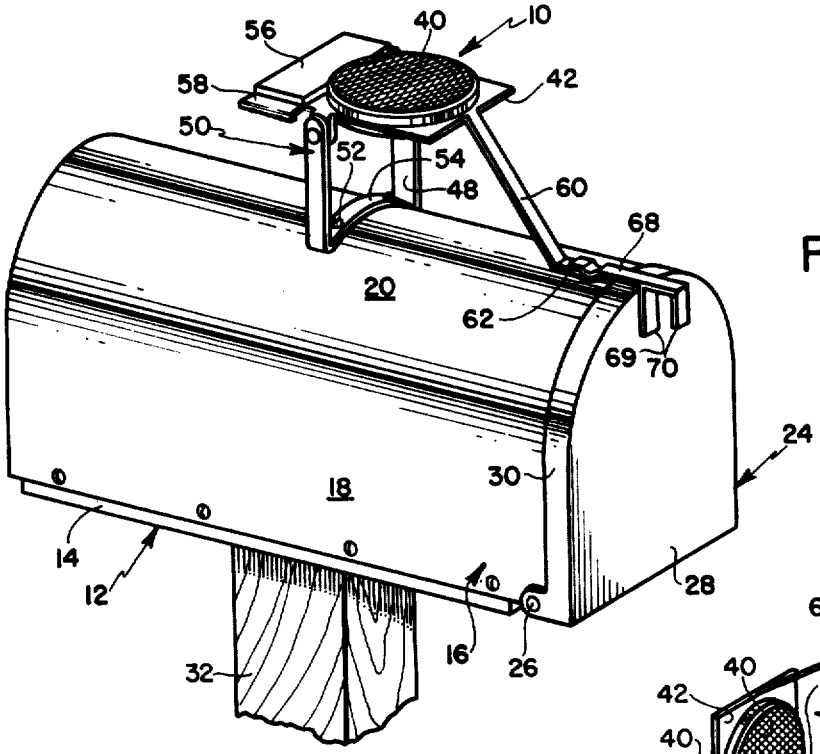
FIG. 1 is a perspective view showing the signal device of the present invention mounted on a conventionbal RFD mailbox and positioned in its first or non-signal position.
Figure 2:
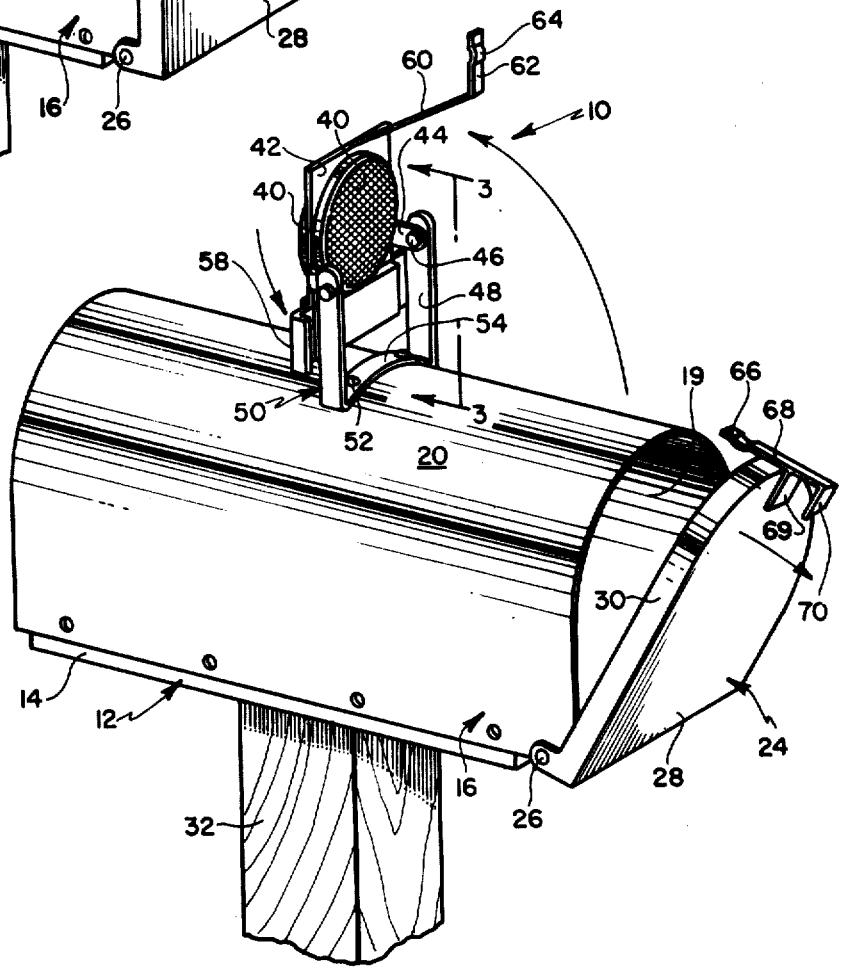
FIG. 2 is a perspective view similar to FIG. 1 but showing the signal device in its upright or vertical position shown in FIG. 1 by opening of the mailbox door.

Turning now to the drawings and particularly FIGS. 1 and 2 thereof, a signal device 10 made in accordance with the present invention is shown mounted in position upon a conventionally shaped mailbox 12 of the type used in RFD service. Such mailbox 12 includes a base 14 and a cover 16 further including upwardly extending sides 18 and a rounded top surface 20. The rear of the box is closed by an upstanding rear wall 22 and the front of the box is open but normally closed by a door 24 pivotally mounted to the side walls 18 thereof by means of conventional construction such as rivets 26 and the like. Accordingly, the door 24 includes a front panel 28 and a rearwardly extending peripheral flange 30 so as to overlap proximal portions of the side and top walls 18 and 20 respectively. Such mailbox 12 is depicted mounted upon a post 32.

Delivery to boxes of the above-described type is normally by mail delivery persons who open the door 24, insert the mail, and thereafter close the door. Such box may also be utilized in conjunction with a signal flag (not shown) of standard construction which is utilized to signal the presence of outgoing mail to be picked up by the delivery person. A feature of the present invention is that it does not interfere with such signal flags when and if they are utilized in conjunction with the mailbox. A further feature of the present invention is that its signal means is operative merely by the opening of the door such that the delivery person does not have to concern himself or herself with an extra step which if omitted would defeat the purpose of the invention. Thus the delivery person does not have to do more than is now normally provided in order for the invention of the present invention to work and thus the receptor of the mail, that is, the addressee, is not dependent upon the delivery person to provide extra service in order for the present invention to function.

Turning now to the signal device 10 of the present invention, such includes a pair of molded reflector buttons 40 mounted on opposite sides of a generally flat plate 42 at signal zones on opposite sides thereof. The buttons 40 may be attached thereto by any conventional means including adhesive connection. Other visually observable means in place of or in addition to buttons, i.e., reflective paint, mirrors, etc. may be utilized. The plate 42 is generally formed from a rigid weather resistent material such as galvanized steel and includes a pair of mounting ears 44 which forwardly extend from the main plane thereof at a right angle relationship. The ends of the ears are provided with openings through which rivets 46 extend. The rivets in turn pass through openings in side arms 48 of a U-shaped bracket 50 which is in turn attached to the upper surface 20 of the mailbox by means of screws, bolts, or other conventional connectors 52 passing through the base 54 of such bracket 50. In this manner then the plate and signal buttons which comprise the signal member of the present invention are pivotally mounted above the top surface of the mailbox.

Figure 3:
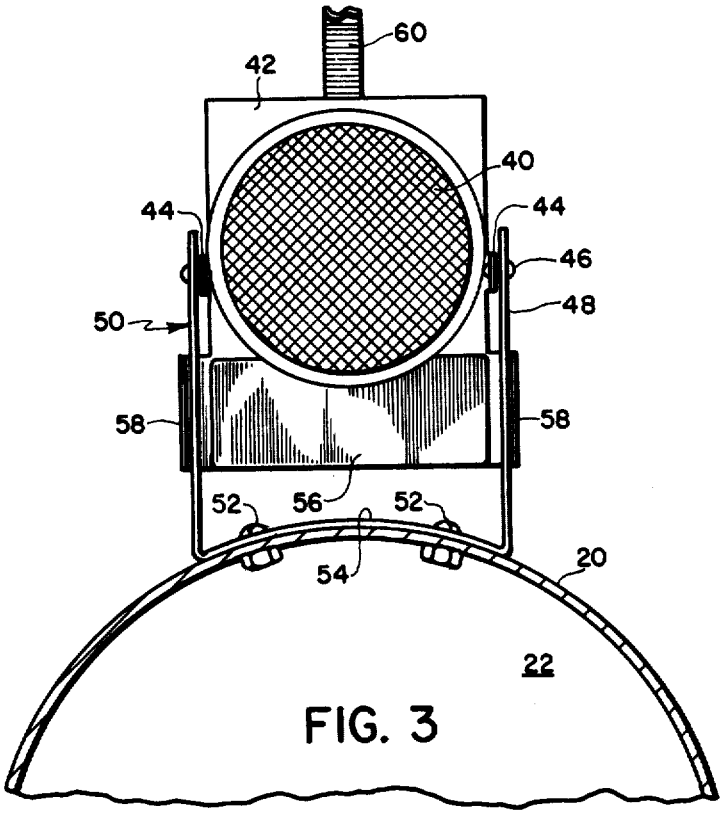
FIG. 3 is a partial front elevational view of the device of the present invention.
Figure 4:
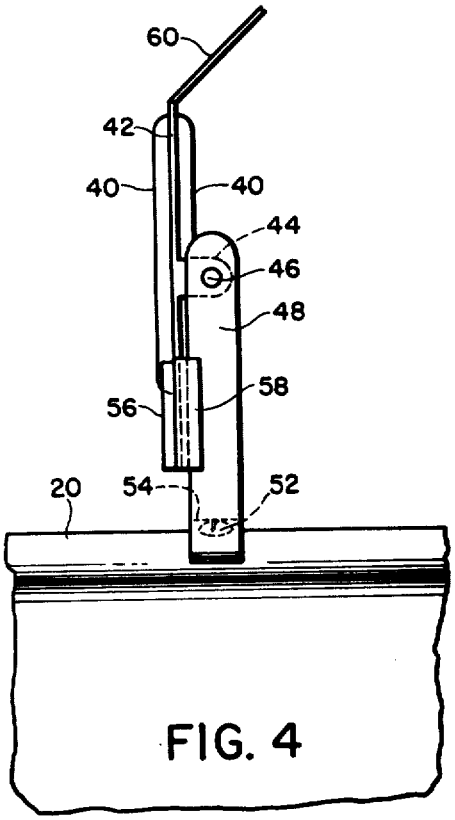
FIG. 4 is a partial side elevational view taken from the left side of FIG. 3.

The lower portion of the plate 42 may be provided with a weight 56 such that the plate 42 will assume an upright or vertical position such as shown in FIGS. 2 through 4 when unrestrained. In order that the plate will not swing in free relationship with respect to the U-shaped bracket 50, a pair of sidewardly extending wings 58 are provided at the lower portion thereof such that the wings 58 abut the upstanding sides 48 of the bracket 50 and thus normally only permit pivotal movement from the position shown in FIG. 1 to the position shown in FIG. 2.

The plate 42 is additionally provided with an indicator arm 60 which downwardly forwardly extends from an upper portion thereof and terminates in an angular finger extension 62. Such finger extension 62 includes a curved contact area 64 adapted to interconnect in frictional engagement with a similarly shaped finger extension 66 rearwardly extending from a door extension arm 68 attached to the door 24. Such door extension arm 68 terminates in a downwardly extending flange 69 which is bolted, screwed, or otherwise connected to the front surface 28 of the door 24. The arm 68 further includes a generally L-shaped finger extension 70 which forwardly projects from the front panel 28 of the door and forms a finger grasping portion whereby the door may be pulled forwardly downwardly so as to gain access into the front opening 19 thereof.

Figure 5:
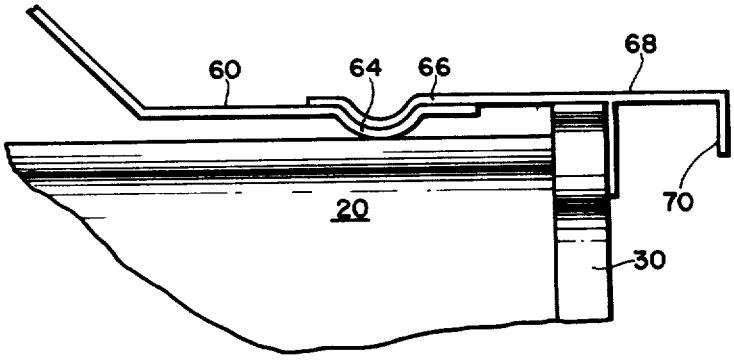
FIG. 5 is a partial side elevational view of a portion of the device showing the manner in which the finger extension of the mailbox door serves to maintain the first position of the signal device such as shown in FIG. 1.

Accordingly when the door 24 is opened, the finger portion 66 which is in frictional engagement with the finger extension 64 as best shown by reference to FIG. 5 moves out of contact therewith and enables the plate 42 to pivot to its upright vertical position by reason of its weighted lower portion. The delivery person then places the mail, etc. into the box 12 and thereafter simply closes the door 24 in the normal manner. In such position, the signal member including the reflector buttons 40 or other signal means such as fluorescent paint, a distinctively shaped plate, a large visible numeral, and the like will be readily observable to the addressee from his house or office such that he or she does not have to continually observe whether the delivery person has been there or not. Once the signal position is observed, it is known that the door has been opened and the trip to the mailbox will not be wasted. Upon receiving the mail, the addressee will then move the signal member to its horizontal position and thereafter close the door such that the finger portion overlies the finger portion 64 of the indicator arm 60 and thus hold the signal member in its first or "no mail" position. Thus the delivery person merely acts as he or she normally does in opening the door, placing the mail, and closing the door. Thus there is no dependency on such delivery person to act out of his normal course of duty in order for the device of the present invention to function in its intended manner.

Figure 6:
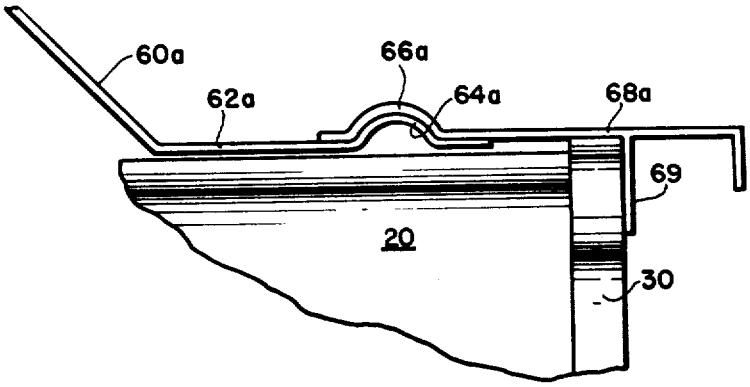
FIG. 6 is a view similar to FIG. 5 but showing an alternate form of the invention.

Turning now to FIG. 6, an alternate manner in which the indicator member may be held in its first or horizontal position is shown. Therein the indicator arm **60*a* is provided with a finger extension 62*a* which includes an upwardly curved portion 64*a*. Such curved portion is adapted to underlie a similarly shaped curved portion 66*a* from the rearwardly extending arm 68*a*. In either event, the arm 68 or 68*a* is adapted to overlie the terminal finger portion 62 or 62*a* of the indicator arm so as to hold the desired non-signal position when the mailbox door is closed and after the mail is removed therefrom. Various alternative forms of the particular structure above-described may be utilized, for instance, the wings 58 instead of being adapted to contact the sides 48** of the bracket centrally of such wings may be more inwardly directed so as to engage the bracket sides in edge-to-edge contact.

Figure 7:
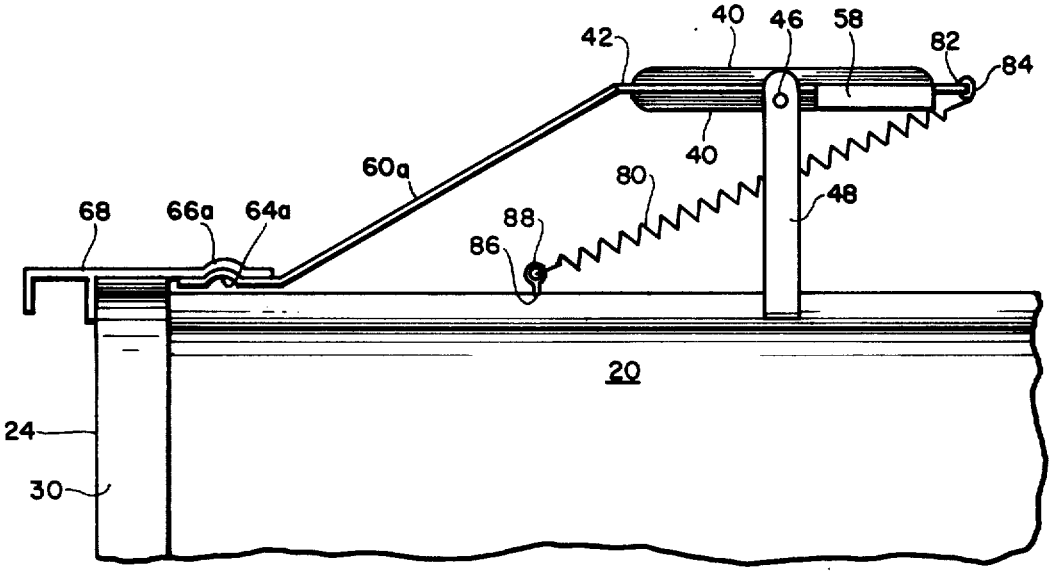
FIG. 7 is a partial side elevational view of an alternate and preferred form of the device illustrated in its first or non-signal position.
Figure 8:
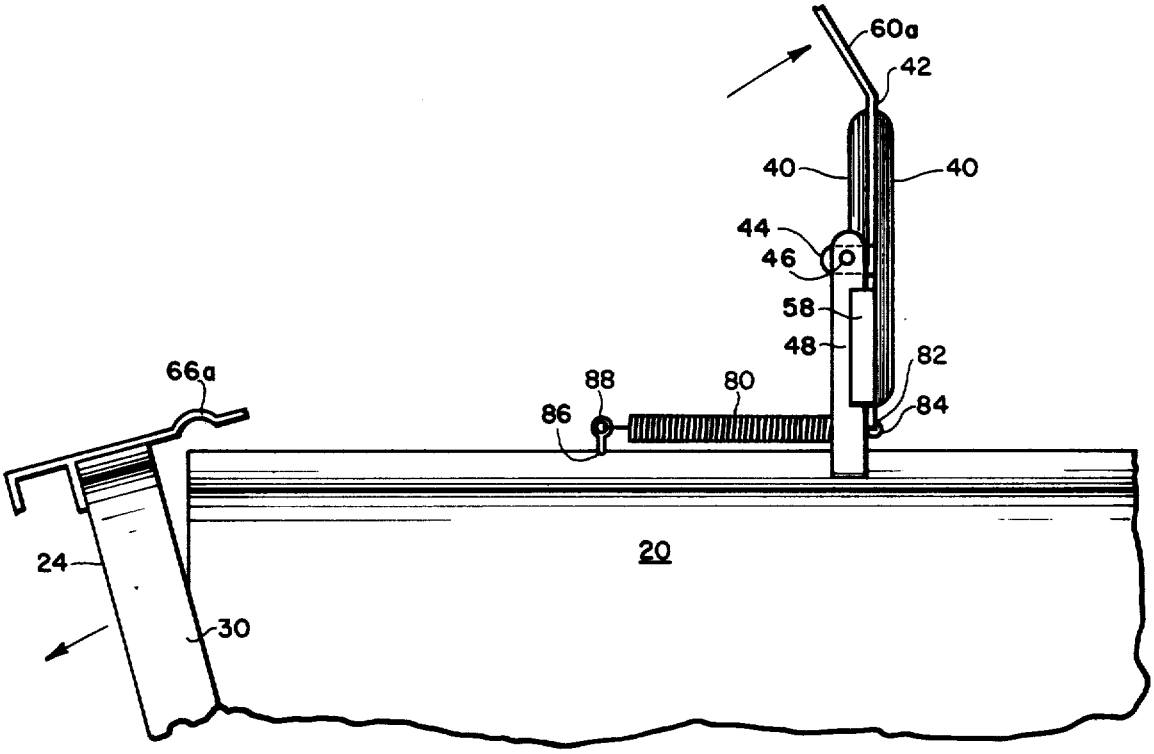
FIG. 8 is a partial side elevational view similar to FIG. 7 but showing the device in its second or signal position.

Turning now to FIGS. 7 and 8 of the drawings, a preferred manner of continually urging the plate 42 to its second or signal position is illustrated. Therein instead of using a weight or weights 56 on one or both lower surfaces of the plate 42 to provide the force necessary to continually urge the plate to its upright position, such may be supplied by a spring 80. In this regard a hole 82 is formed in the lower area of the plate 42 to which one end of the spring 80 is connected by insertion of a hook-shaped finger 84 or equivalent connector element thereinto. The other end of the spring 80 is similarly connected to a forward portion of the mailbox upper surface 20 either directly into a hole 86 provided therethrough or to an eyelet 88 or similar connector element in turn mounted to the mailbox 12. In the FIG. 7 position the spring 80 is extended and thus continually places a force upon the plate to pivot it to its upright position shown in FIG. 8. When the mailbox door 24 is opened, the restraint on the plate 42 via the indicator arm 60 or **60*a*** is released and the plate moves to its signal position as previously indicated.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A signal device for use in conjunction with mailboxes and the like of the type having a generally elongated body with a downwardly pivotable door mounted at a forwardly directed access opening thereto, said device comprising a signal member which readily is visually observable in a generally upright attitude, means for pivotally mounting said signal member above said body such that it is pivotal from a first and non-signal position wherein said member is disposed in a generally horizontal attitude to a second and signal position wherein said member is in said readily visible general upright attitude, first positioning means associated with said mailbox door for positioning said signal member in said first position when said door is closed and second positioning means for automatically moving said signal member to said second position when said door is opened, said first positioning means including a relatively rigid indicator arm downwardly forwardly extending from said signal member for frictional engagement with means associated with said mailbox door to maintain said signal member in said first position, said means associated with said mailbox door being a relatively rigid arm attached to said door and extending rearwardly for frictional engagement with said indicator arm, each of said arms terminating in a curved finger portion, said finger portions adapted to overlie each other so as to provide said frictional engagement whereby said signal member is held in said first position yet readily release said engagement when said door is opened.

2. The signal device of claim 1, said door extension arm including a forwardly extending, generally L-shaped finger engageable latch handle for opening said door.

3. A signal device for use in conjunction with mailboxes and the like of the type having a generally elongated body with a downwardly pivotable door mounted at a forwardly directed access opening thereto, said device comprising a signal member which readily is visually observable in a generally upright attitude, means for pivotally mounting said signal member above said body such that it is pivotal from a first and non-signal position wherein said member is disposed in a generally horizontal attitude to a second and signal position wherein said member is in said readily visible general upright attitude, first positioning means associated with said mailbox door for positioning said signal member in said first position when said door is closed and second positioning means for automatically moving said signal member to said second position when said door is opened, said first positioning means including a relatively rigid indicator arm downwardly forwardly extending from said signal member for frictional engagement with means associated with said mailbox door to maintain said signal member in said first position, said means associated with said mailbox door being a relatively rigid arm attached to said door and extending rearwardly for frictional engagement with said indicator arm, said signal member including a generally flat carrier plate having signal zones on opposite upper surfaces thereof, said means for pivotally mounting said member being a generally U-shaped bracket including a base and upstanding side posts, said base adapted for connection to an upper surface of said mailbox body and said side posts adapted to pivotally support said plate, said second positioning means adapted to automatically move said plate to its upright position when unrestrained by said first positioning means, said second positioning means adapted to continually urge said plate to its second and signal position, further including means to limit the pivotal movement of said member to its generally upright signal position by preventing movement of said plate past the side posts of said bracket, said movement limiting means being sidewardly extending wings provided on the lower portion of said plate, said wings adapted to abut said bracket side posts on the rear sides thereof so as to assure positive positioning of said signal member in its second signal position.

* * * * *